United States Patent [19]

Aoki et al.

[11] Patent Number: 4,632,069

[45] Date of Patent: Dec. 30, 1986

[54] COOLING SYSTEM FOR AUTOMOTIVE ENGINE

[75] Inventors: Hirofumi Aoki, Chigasaki; Yoshimasa Hayashi, Kamakura, both of Japan

[73] Assignee: Nissan Motor Co., Ltd., Yokohama, Japan

[21] Appl. No.: 705,928

[22] Filed: Feb. 26, 1985

[30] Foreign Application Priority Data

Feb. 29, 1984 [JP] Japan ..... 59-38280

[51] Int. Cl.[4] ..... F01P 3/22; F01P 5/14

[52] U.S. Cl. ..... 123/41.15; 123/41.21; 123/41.27; 123/198 D

[58] Field of Search ..... 123/41.15, 41.2, 41.27, 123/41.02, 198 D

[56] References Cited

U.S. PATENT DOCUMENTS

| | | | |
|---|---|---|---|
| 1,687,679 | 10/1928 | Mallory | 123/41.27 |
| 1,787,562 | 1/1931 | Barlow | 123/41.44 |
| 3,893,108 | 7/1975 | McBride, Jr. et al. | 123/41.15 |
| 4,367,699 | 1/1983 | Evans | 123/41.23 |

FOREIGN PATENT DOCUMENTS

| | | | |
|---|---|---|---|
| 144622 | 8/1983 | Japan | 123/41.15 |

*Primary Examiner*—William A. Cuchlinski, Jr.

*Attorney, Agent, or Firm*—Schwartz, Jeffery, Schwaab, Mack, Blumenthal & Evans

[57] ABSTRACT

In order to detect cooling system malfunction, the operation of a pump which recycles the liquid coolant from a radiator (or condensor) to the coolant jacket of a vapor cooled type engine, is monitored. In the event that the pump operation period and frequency (viz., the time between changes in pump operation) fail to fall within a predetermined time schedule, a malfunction indicating signal is issued. The schedule can be varied in accordance with a signal indicative of the amount of fuel being combusted in the engine (viz., the amount of heat being produced by the engine) so as to take into the account the increased amount of coolant circulation which occurs under high engine load operation and the accompanying changes in pump operation characteristics.

13 Claims, 12 Drawing Figures

100
104
106
120
122
123
126
127
128
130
132
134(II)
136
140
144
146
148
149
150
152(I)
166
167
168
169
170(III)
180
CPU
ROM
RAM
I/O
I/O
182
184
MALFUNCTION DETECTION CKT
DIFFERENTIAL CKT
PERIOD DETECTION CKT
COMPARATOR
WARNING INDICATOR
DRIVER CKT
200
210
212
214
216
218

146
148
149
150
152(I)
100
106
104
120
169
170(III)
166
168
167
140
144
136
132
122
127
123
132
126
130
134(II)
128
180
CPU
ROM
RAM
I/O
I/O
182
184
MALFUNCTION DETECTION CKT
310
TIMER CKT
FUEL CONSUMPTION RATE DETECTION CKT
WARNING INDICATOR

COOLING SYSTEM FOR AUTOMOTIVE ENGINE

BACKGROUND OF THE INVENTION

1. Field of the Invention

The present invention relates generally to a cooling system for an internal combustion engine wherein liquid coolant is boiled to make use of the latent heat of vaporization thereof and the vapor used as a vehicle for removing heat from the engine, and more specifically to such a system which includes circuitry which monitors the operation of an arrangement which recycles condensed coolant back to the coolant jacket of the system for re-evaporation and which issues an alarm when the recycling characteristics indicate that a malfunction has occured in the system.

2. Description of the Prior Art

In currently used "water cooled" internal combustion engines such as shown in FIG. 1 of the drawings, the engine coolant (liquid) is forcefully circulated by a water pump, through a circuit including the engine coolant jacket and an air cooled radiator. This type of system encounters the drawback that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having 1800 cc displacement (by way of example) is operated at full throttle, the cooling system is required to remove approximately 4000 Kcal/h. In order to achieve this a flow rate of 167 Liter/min (viz., $4000-60\times\frac{1}{4}$) must be produced by the water pump. This of course undesirably consumes a number of otherwise useful horsepower.

FIG. 2 shows an arrangement disclosed in Japanese Patent Application Second Provisional Publication No. Sho 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement has suffered from the drawbacks that the radiator, depending on its position with respect to the engine proper tends to be at least partially filled with liquid coolant. This greatly reduces the surface area via which the gaseous coolant (for example steam) can effectively release its latent heat of vaporization and accordingly condense and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to gradually escape from the system, inducing the need for frequency topping up of the coolant level.

A further problem with this arrangement has come in that some of the air, which is sucked into the cooling system as the engine cools, tends to dissolve in the water, whereby upon start up of the engine, the dissolved air tends to form small bubbles in the radiator which adhere to the walls thereof forming an insulating layer. The undisolved air tends to collect in the upper section of the radiator and inhibit the convection-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not circulated therein and permitted to absorb heat to the point of boiling. The gaseous coolant thus generated is adiabatically compressed in a compressor so as to raise the temperature and pressure thereof and introduced into a heat exchanger. After condensing, the coolant is temporarily stored in a reservoir and recycled back into the coolant jacket via a flow control valve.

This arrangement has suffered from the drawback in that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms large bubbles of air which cause a kind of "embolism" in the radiator and badly impair the heat exchange ability thereof.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the "dry" gaseous coolant (steam for example) is condensed in a fan cooled radiator 8. The temperature of the radiator is controlled by selective energizations of the fan 9 to maintain a rate of condensation therein sufficient to maintain a liquid seal at the bottom of the device. Condensate discharged from the radiator via the above mentioned liquid seal is collected in a small reservoir-like arrangement 10 and pumped back up to the separation tank via a small pump 11.

This arrangement, while providing an arrangement via which air can be initially purged from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. The provision of the separation tank 6 also renders engine layout difficult.

Japanese Patent Application First Provisional Publication No. Sho. 56-32026 (see FIG. 4 of the drawings) discloses an arrangement wherein the structure defining the cylinder head and cylinder liners are covered in a porous layer of ceramic material 12 and coolant sprayed into the cylinder block from shower-like arrangements 13 located above the cylinder heads 14. The interior of the coolant jacket defined within the engine proper is essentially filled with gaseous coolant during engine operation during which liquid coolant sprayed onto the ceramic layers 12. However, this arrangement has proved totally unsatisfactory in that upon boiling of the liquid coolant absorbed into the ceramic layers the vapor thus produced escaping into the coolant jacket inhibits the penetration of liquid coolant into the layers whereby rapid overheat and thermal damage of the ceramic layers 12 and/or engine soon results. Further, this arrangement is plagued with air contamination and blockages in the radiator similar to the compressor equipped arrangement discussed above.

U.S. Pat. No. 1,787,562 issued on Jan. 6, 1931 in the name of Barlow, discloses a vapor cooled engine wherein a level sensor is disposed in the coolant jacket and arranged to control a pump which recycles condensed coolant from a small reservoir located at the base of the radiator in which coolant vapor is condensed, back to the coolant jacket. However, in this system the interior of the system is vented to the atmosphere via a small valve disposed atop of the reservoir. Accordingly, with this system although some provision is made for displacing the air which inevitably enters the cooling circuit of this arrangement, this very provision prevents control of the boiling point of the coolant via varying the pressure within the system. Further, the low level location of the valve inhibits complete purging of the air which exters the system during non-use.

Moreover, with the above arrangement, should the system develop a leak or otherwise lose coolant in a manner that insufficient liquid is available for providing adequate cooling of the system, no warning device or the like is provided to bring attention to this fact. Thus, the engine is likely to undergo severe thermal damage.

In summary, although the basic concepts of open and closed "vapor cooling" systems wherein the coolant is boiled to make use of the latent heat of evaporation thereof and condensed in a suitable heat exchanger, is known, the lack of a control system which is both sufficiently simple as to allow practical use and which overcomes the various problems plauging the prior art is wanting.

SUMMARY OF THE INVENTION

It is an object of the present invention to provide a "vapor" type cooling system for an internal combustion engine or like device which apart from preventing the intrusion of non-condensible matter such as air and the like into the system also, includes a monitoring circuit which does not require special sensors of its own and which issues a signal indicative of cooling system malfunction.

In brief, in order to achieve the above object, the operation of a pump which recycles the liquid coolant from a radiator (or condenser) to the coolant jacket of a vapor cooled type engine, is monitored. In the event that the pump operation period and frequency (viz., the time between changes in pump operation) fail to fall within a predetermined time schedule, a malfunction indicating signal is issued. The schedule can be varied in accordance with a signal indicative of the amount of fuel being combusted in the engine (viz., the amount of heat being produced by the engine) so as to take into the account the increased amount of coolant circulation which occurs under high engine load operation and the accompanying changes in pump operation characteristics.

This arrangement of course provides a very simple and reliable method of detecting low coolant levels and/or similar malfunctions and eliminates the need for a number of complex and expensive sensors to be disposed in various locations in the cooling circuit.

In more specific terms a first embodiment of the present invention is deemed to take the form of a cooling system for an internal combustion engine comprising: a coolant jacket formed about structure of the engine subject to high heat flux; a radiator in which coolant vapor is condensed to liquid form; a vapor transfer conduit leading from the coolant jacket to the radiator; means for returning liquid coolant from the radiator to the coolant jacket in a manner to maintain the level of liquid coolant in the coolant jacket above the structure subject to high heat flux and lower than the uppermost section of the coolant jacket so as to provide a vapor collection space above the surface of the liquid coolant; and a circuit which monitors the operation of the liquid coolant returning means and which issues a signal upon the operational characteristics of the liquid coolant returning means indicating a malfunction in the cooling system.

A second aspect of the present invention is deemed to come in a method of cooling an internal combustion engine comprising the steps of: introducing liquid coolant into a coolant jacket formed about structure of the engine subject to high heat flux in a manner to immerse the structure in a predetermined depth of liquid coolant; allowing the liquid coolant in the coolant jacket to boil; transferring the coolant vapor produced by the boiling in the coolant jacket from the coolant jacket to a radiator using a vapor transfer conduit; condensing the vapor to its liquid form in the radiator; returning liquid coolant from the radiator to the first coolant jacket using a coolant return arrangement in a manner to maintain the structure subject to high heat flux immersed in the predetermined depth of liquid coolant and define a vapor collection space within the coolant jacket; monitoring the operation of the liquid coolant returning means; and issuing a signal upon the step of monitoring indicating that the operation characteristics of the coolant returning means deviates from a predetermined schedule.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of the actual embodiment of the present invention, it is deemed advantageous to firstly discuss the concepts on which the present invention is based.

Figure 5:
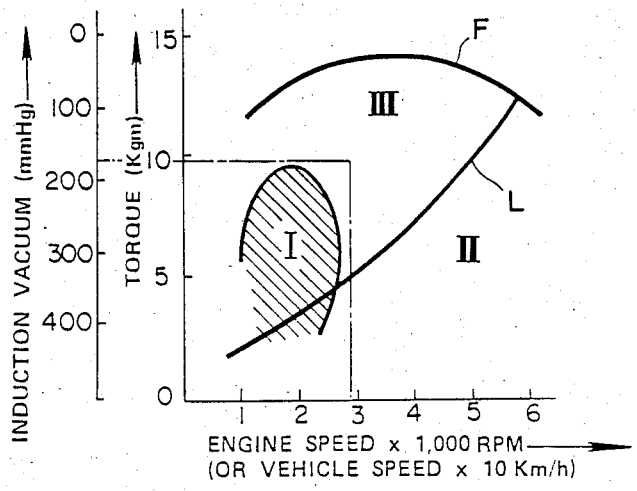
FIG. 5 is a graph showing in terms of engine torque and engine/vehicle speed the various load zones encounted by an automotive vehicle.

FIG. 5 graphically shows, in terms of engine torque and engine speed, the various load "zones" which are encountered by an automotive vehicle engine. In this graph, the curve F denotes full throttle torque characteristics, trace L denotes the resistance encountered when a vehicle is running on a level surface, and zones I, II and III denote respectively what shall be referred to as "urban cruising", "high speed cruising" and "high load operation" (such as hillclimbing, towing etc.).

A suitable coolant temperature for zone I is in the order of 120° C. (for example) while as low as 90° C. (for example) for zones II and III. If desired it is possible to induce the coolant to boil at approximately 100° C. in zone II if so desired.

The high temperature during "urban cruising" promotes improved thermal efficiency and fuel economy while the lower temperatures promote improved charging efficiency while simultaneously removing sufficient heat from the engine and associated structure to obviate engine knocking and/or possibility of engine damage in the other zones.

Figure 6:
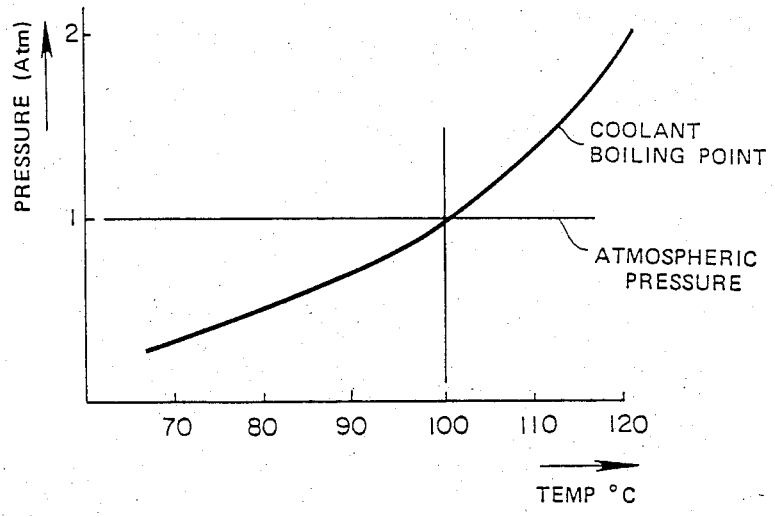
FIG. 6 is a graph showing in terms of pressure and temperature, the change which occurs in the coolant boiling point with change in pressure.

With the present invention, in order to control the temperature of the engine, advantage is taken of the fact that with a cooling system wherein the coolant is boiled and the vapor used a heat transfer medium, boiling is most vigorous in zones of high heat flux, whereby the temperature of engine structure subject to high heat flux is maintained essentially equal to that of structure subject to less intensive heating whereat boiling is less vigorous and less heat removed; the amount of coolant actually circulated between the coolant jacket and the radiator is very small; the amount of heat removed from the engine per unit volume of coolant is very high; and upon boiling, the pressure prevailing within the coolant jacket and consequently the boiling point of the coolant rises if the system employed is closed. Thus, by circulating a controlled amount of cooling air over the radiator, it is possible reduce the rate of condensation therein and cause the pressure within the cooling system to rise above atmospheric and thus induce the situation, as shown in FIG. 6, wherein the engine coolant boils at temperatures above 100° C.—for example at approximately 110° C.

On the other hand, during high speed cruising, it is further possible by increasing the flow of cooling air passing over the radiator (for example by energizing a cooling fan as required to supplement the natural draft of air which occurs under such conditions) to increase the rate of condensation within the radiator to a level which reduces the pressure prevailing in the cooling system below atmospheric and thus induce the situation wherein the coolant boils at temperatures below 100° C.—for example at approximately 90° C.

Figure 7:
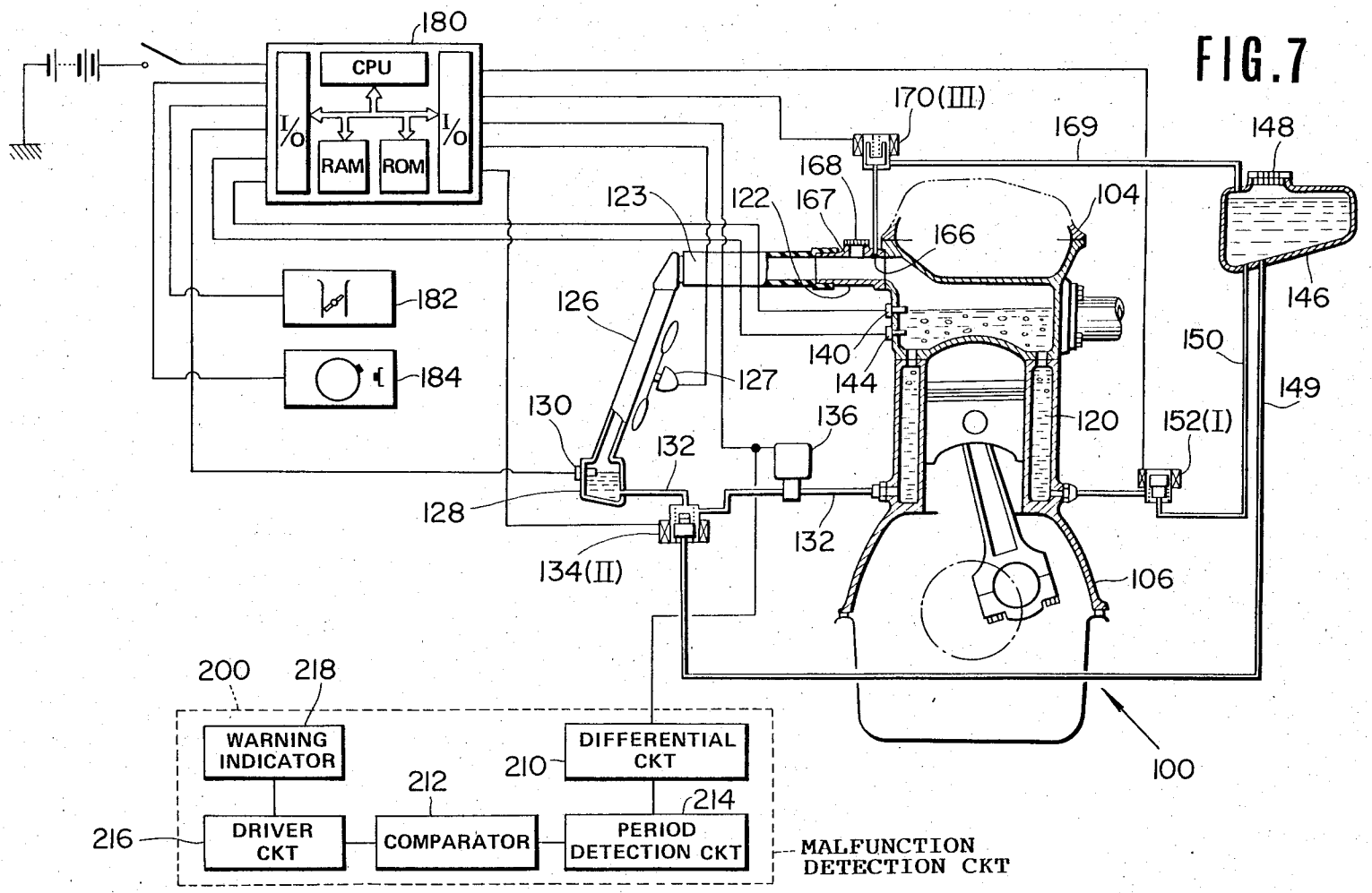
FIG. 7 is a schematic partially sectioned view showing a "vapor" cooled type engine system equipped with a first embodiment of the present invention.

FIG. 7 shows an engine system incorporating a first embodiment of the present invention. In this arrangement, an internal combustion engine 100 includes a cylinder block 106 on which a cylinder head 104 is detachably secured. The cylinder head 104 and cylinder block 106 include suitable cavities which define a coolant jacket 120 about the heated portions of the cylinder head and block.

Fluidly communicating with a vapor discharge port of the cylinder head 104 via a vapor manifold 122 and vapor transfer conduit 123, is a radiator or heat exchanger 126. It should be noted that the interior of this radiator 126 is maintained essentially empty of liquid coolant during normal engine operation so as to maximize the surface area available for condensing coolant vapor (via heat exchange with the ambient atmosphere) and that the cooling system as a whole (viz., the cooling circuit encompassed by the coolant jacket, radiator and conduiting interconnecting same) is hermetically closed when the engine is warmed-up and running. These features will become clearer as the description proceeds.

If deemed advantageous a mesh screen or like separator (not shown) can be disposed in the vapor discharge port 121 of the cylinder head so as to minimize the transfer of liquid coolant which tends to froth during boiling, to the radiator 126. Alternatively, cylinder head/manifold arrangements such as disclosed in U.S. Pat. No. 4,499,866 issued on Feb. 19, 1985 in the name of Hirano and U.S. patent application Ser. No. 642,369 filed June 25, 1984 in the name of Hirano et al, can be employed if desired.

Located suitably adjacent the radiator 126 is a electrically driven fan 127. Defined at the bottom of the radiator 126 is a small collection reservoir or lower tank 128 as it will be referred to hereinafter. Disposed in the lower tank 128 is a level sensor 130 which is adapted to output a signal indicative of the level of liquid coolant in the lower tank 128 falling therebelow. Viz., being lower than a level which is beneath the lower ends of the relatively small diameter tubing which constitute heat exchanging portion the radiator.

Leading from the lower tank 128 to the cylinder block 120 is a return conduit 132. As shown, a "three-way" type electromagnetic valve 134 and a relatively small capacity return pump 136 are disposed in this conduit. The valve 134 is located upstream of the pump 136. The return conduit 132 is arranged to communicate with the lowermost portion of the coolant jacket 120.

In order to sense the level of coolant in the coolant jacket and appropriately control the operation of the pump 136, a level sensor 140 is disposed as shown. It will be noted that this sensor is arranged at a level higher than that of the combustion chambers, exhaust ports and valves (i.e. structure subject to high heat flux) so as to enable same to be securely immersed in coolant and thus attenuate any engine knocking and the like which might otherwise occur due to the formation of localized zones of abnormally high temperature or "hot spots". It will also be noted that the level sensor 140 is located at a level lower than the upper section or roof of the structure of the cylinder head which defines the coolant jacket therein, so as to define a coolant vapor collection space above the liquid coolant.

Located below the level sensor 140 so as to be immersed in the liquid coolant is a temperature sensor 144.

A coolant reservoir 146 is located beside the engine proper as shown. An air permeable cap 148 is used to close the reservoir 146 in a manner that atmospheric pressure continuously prevails therein.

The reservoir 146 fluidly communicates with the "three-way" valve 134 via a supply conduit 149 and with the engine coolant jacket 120 via a fill/discharge conduit 150 and an ON/OFF type electromagnetic valve 152. The three-way valve 134 is arranged to establish fluid communication between the lower tank 128 and the coolant jacket 120 when de-energized while establish fluid communication between the coolant jacket 120 and the reservoir 146 when energized. Valve 152 is arranged to be closed when energized.

The vapor manifold 122 is formed with a "purge" port 166 and a riser like portion 167 which is hermetically closed by a cap 168. The purge port 166, as shown, communicates with the reservoir 164 via a overflow conduit 169. A normally closed electromagnetic valve 170 is disposed in the overflow conduit 169. This valve is arranged to be open only when energized.

The above mentioned level sensors 130 & 140 may be of any suitable type such as float/reed switch types.

As shown, the outputs of the level sensors 130 & 140 and temperature sensor 144 are fed to a control circuit 180. In this embodiment the control circuit 180 includes therein a microprocessor including input and output interfaces I/O a CPU, a RAM and a ROM. Suitable control programs are set in the ROM and are used to control the operation of the valves 134, 152 & 170, pump 136 and fan 127 in response to the various data supplied thereto.

In order that the temperature of the coolant be appropriately controlled in response to changes in engine load and speed, a load sensor 182 and an engine speed sensor 184 are arranged to supply data signals to control circuit 180. The load sensor may take the form of a throttle position switch which is tiggered upon the engine throttle valve being opened beyond a predetermined degree. Alternatively the output of an air flow meter or an induction vacuum sensor may be used. The engine speed signal may be derived from the engine distributor, a crankshaft rotational speed sensor or the like.

It is within the scope of the present invention to arrange for a look-up table of the nature of that shown in FIG. 5 to be provided in the ROM of the microprocessor, or alternatively programs may be suitably devised to achieve the desired load/engine speed responsive temperature control in response to the inputted data signals. For further disclosure relating to this particular control reference should be had to the documents incorporated by reference hereinlater.

Prior to initial use the cooling system (including the heat exchanger housing passages 804) is completely filled with coolant (for example water or a mixture of water and antifreeze or the like) and the cap 168 securely set in place to seal the system. A suitable quantity of additional coolant is also introduced into the reservoir 146. Although at this time by using de-aerated water when initially filling the system and reservoir, the system is essentially free of contaminating air etc., over a period of time non-condensible matter will find its way into the system. For, example the water (coolant) in the reservoir 146 will tend to absorb atmospheric air and each time the system is filled with coolant (explanation given in detail later) a little non-condensible matter will tend to find its way into the system. Further, during given modes of engine operation, negative pressures develop and although the system is operating in a sealed or closed mode at the time, air, little by little, tends to leak into the system via the gasketing and the like defined between the cylinder head and cylinder block and between the seals defined between conduiting and associated elements of the system.

Accordingly, upon start-up of the engine, given that the engine temperature is below a predetermined value (45° C. for example) a non-condensible matter purge operation is carried out. In this embodiment the purge operation is effected by pumping excess coolant into the system for a predetermined period of time. As the system should be essentially full before the initiation of this operation, the excess coolant thus introduced, positively displaces any air or the like the might have collected. In this embodiment the purge operation is carried out by energizing valves 152, 134 and 170 and energizing the pump for several tens of seconds. More specifically, valve 152 is conditioned to assume a closed condition, valve 170 an open one and valve 136 conditioned to establish communication between the reservoir 146 and the coolant jacket 120. Thus, pump inducts coolant from the reservoir 146 via conduit 149 and forces same into the coolant jacket through conduit 132. The excess coolant thus introduced accordingly escapes from the top of the system via overflow conduit 169 and is returned to the reservoir. Any air or like non-condensible matter is carried out of the system along with the overflowing coolant.

Upon termination of this mode of operation the system enters a so called "excess coolant displacement mode" wherein the coolant is permitted to heat, produce vapor pressure and displace itself out of the system back to the reservoir via conduit 150. In order to achieve this, only valve 152 is energized to assume an open state while valves 170 and 134 are deenergized to respectively assume a closed position and one in which the coolant jacket 120 is placed in fluid communication with the reservoir 146.

Figure 1:
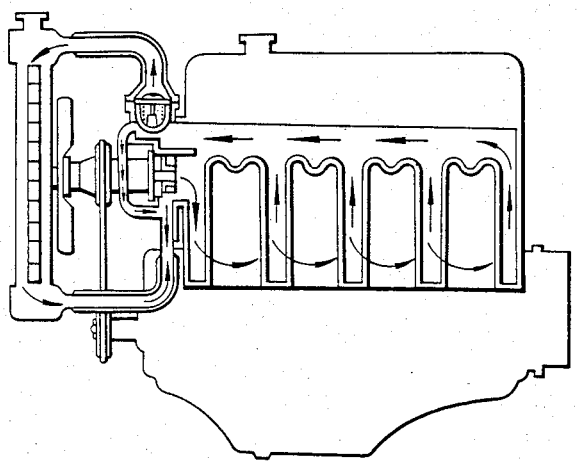
FIG.1 (PRIOR ART)
FIG. 1 is a partially sectioned elevation showing a currently used conventional water circulation type system discussed in the opening paragraphs of the instant disclosure.
Figure 2:
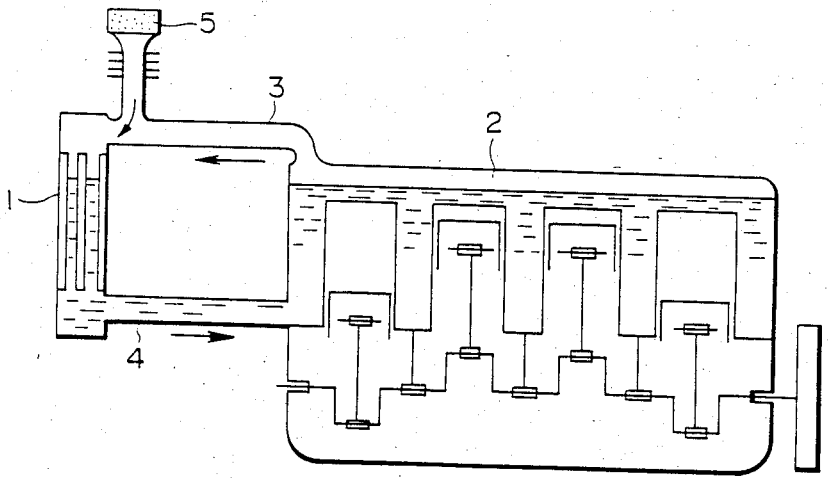
FIG.2 (PRIOR ART)
FIG. 2 is a schematic side sectional elevation of a prior art arrangement also discussed briefly in the earlier part of the specification.
Figure 3:
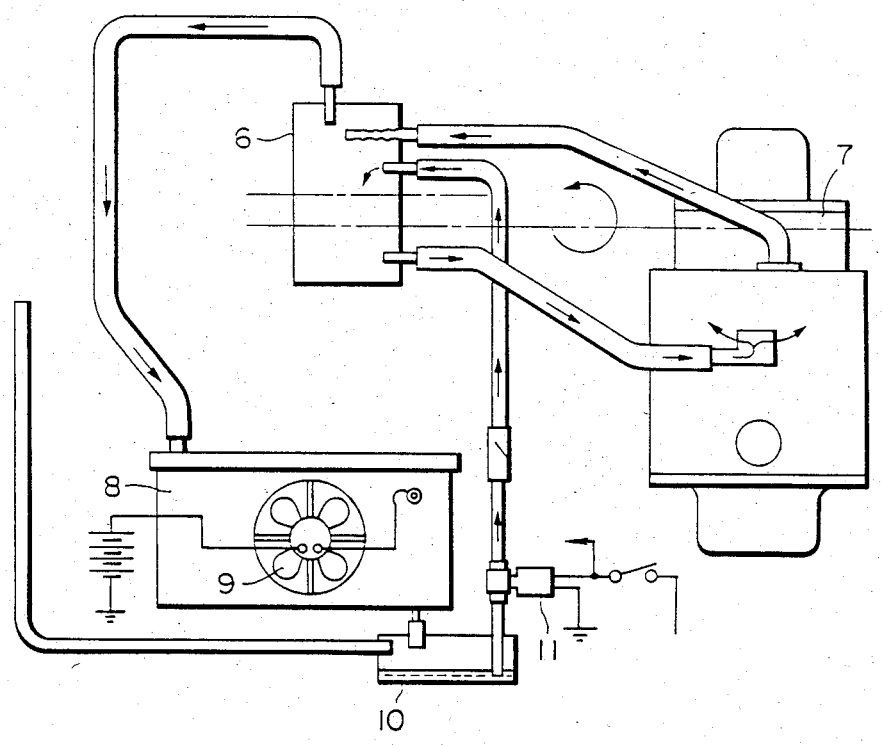
FIG. 3 (PRIOR ART)
FIG. 3 shows in schematic layout form, another of the prior art arrangements previously discussed.
Figure 4:
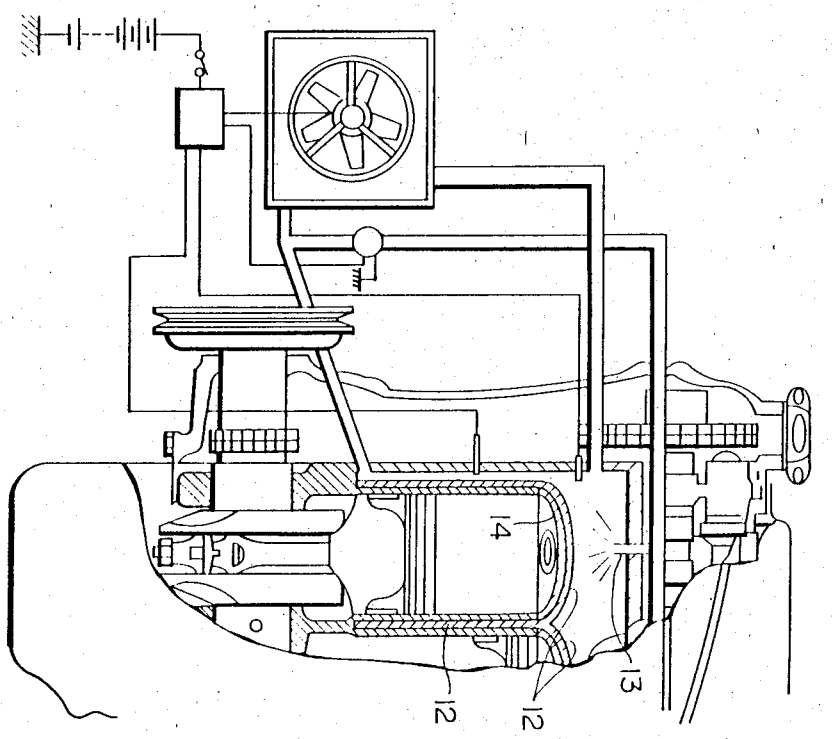
FIG.4 (PRIOR ART)
FIG. 4 shows in partial section yet another of the previously discussed prior art arrangements.

As the coolant is displaced out of the system, the level of liquid coolant falls below that of level sensor 140. Accordingly, pump 136 is energized and coolant is pumped from the radiator 126 into the coolant jacket so as to maintain the level of coolant therein at that of level sensor 140. Accordingly, as coolant is simultaneously being displaced from the system via conduit 150, the radiator and second vapor conduit are emptied of coolant until the situation show in FIG. 1 occurs.

It will be noted that as the system is initially filled with coolant, as the coolant is not circulated as in conventional type circulation systems, very little heat can be removed from the engine whereby the coolant and the engine rapidly warm-up and quickly produces the necessary vapor pressure to carry out the above discussed "displacement" mode of operation.

Figure 10:
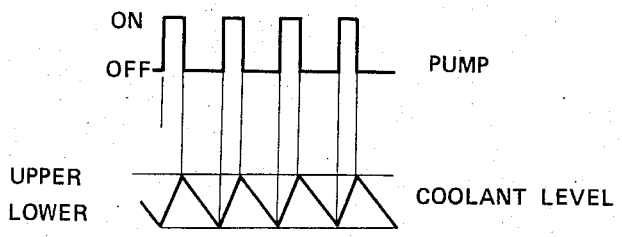
FIG. 10 is a chart showing the correspondence between the pump operation and the change in coolant level within the coolant jacket of the engine system to which the embodiments of the present invention are applied.

During normal operation the vapor produced in the coolant jacket 120 is condensed in the radiator. The rate at which the vapor is condensed is controlled in accordance with the engine load and rotational speed as mentioned earlier. During this mode pump 136 is operated as shown in FIG. 10. Viz, level sensor 140 is arranged to output a signal indicative of the coolant having fallen below a first predetermined level and maintain said output until the coolant has risen to a second level which is higher than the first. This hysteresis action of course obviates rapid ON/OFF cycling of the pump.

When the engine is stopped, due to "thermal inertia" phenomenon, caused by the heat capacity of the cylinder head, cylinder block etc., the coolant will inevitably continue to boil for a short period. This tends to generate a slightly superatmospheric pressure within the system. Accordingly, it is deemed necessary to allow the coolant temperature to drop to a level whereat a slightly sub-atmospheric pressure prevails before permitting the system to assume an open state. This obviates the tendency of large quantities of coolant be displaced out of the system and ensures that upon the system being placed in an open condition that the coolant stored in the reservoir will be smoothly inducted to fill the system. That is to say, as the vapor condenses the coolant from the reservoir will inducted in a manner to replace same and hence completely fill the system. This eliminates the tendency for any atmospheric air to seek its way into the system due to the presence of a sub-atmospheric pressure.

If the engine is restarted before the temperature of the coolant has lowered to any notable degree (for example 45° C.), the system immediately undergoes a "warm start" wherein the purge operation is by-passed and the coolant displaced mode directly entered.

However, with the above described system it will be noted that:

(i) if the pump 136 per se were to fail, then irrespective of energization signals fed thereto from the control circuit 180, coolant would not be recirculated from the collection tank 128 to the coolant jacket 120. Accordingly, the coolant in the coolant jacket 120 would be gradually boiled off leading to (a) too much coolant in the radiator (viz. the radiator would become partially flooded and the surface area via which latent heat of vaporization which can be released to the ambient atmosphere, reduced) and (b) too little in the coolant jacket. Accordingly, as the cylinder head would not be immersed in sufficient coolant to remove the heat emitted therefrom the engine would undergo rapid overheating and thermal damage;

(ii) if level sensor 140 were to malfunction in a manner as to not output an indication of the coolant having fallen below same, then the above situation would occur even though the pump were fully operative;

(iii) conversely, if the level sensor were to malfunction in a manner to continuously output a signal indicative of the coolant level having fallen below same, irespective of the actual liquid level, then pump would be continuously energized. This apart from being unnecessary could lead to overfilling of the coolant jacket whereby coolant would be apt to constantly overflow to the radiator. This of course would tend to wet at least part of the radiator conduiting and lead to a reduction in heat exchange efficiency;

(iv) if the conduiting interconnecting the radiator and coolant jacket fails and allows liquid coolant to leak out of the system, as the level of coolant in the coolant jacket falls, level sensor 140 would induce energization of pump 136. However, due to the chronic lack of coolant, pump 136 would be continuously energized in a effort to replace the lost coolant;

(v) if insufficient coolant were to be contained in the cooling circuit upon the system being switched from open to closed circuit operation, the lack of same would tend to induce prolonged pump operation similar to the case of (iv).

Accordingly, by simply monitoring the time between changes in pump operation, viz., the time for which the pump 136 is on or off, it is possible to detect a malfunction in the system without the need for a plurality of additional sensors which add both cost and weight to the system.

A first embodiment of a malfunction detection circuit 200 according to the present invention is incorporated with the engine system shown in FIG. 7.

This arrangement includes a differential circuit 210 which is connected to the "live" terminal of the pump 136 so as to be responsive to the energization signals fed thereto. Connected in series between the differential circuit 210 and a comparator 212 is a circuit 214 which detects the period for which the pump 136 operates and is non-operative. Following the comparator 212 is a driver or amplifier circuit 216 which upon receiving an output from the comparator generates a suitable voltage signal via which an alarm indicator 218—such as a lamp or buzzer (or alternatively a voice warning system) is energized.

Figure 9:
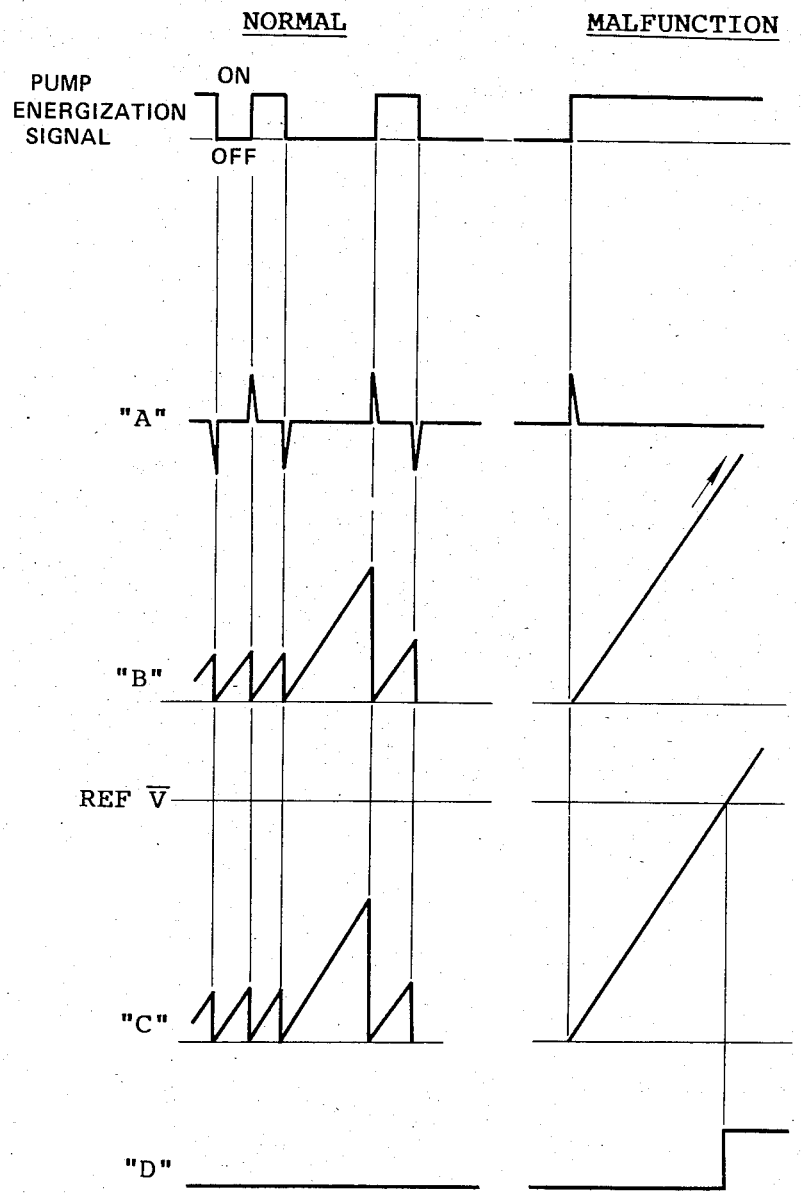
FIG. 9 is a timing chart showing the operation of the monitoring circuit which characterizes the first embodiment.

FIG. 9 shows in timing chart form, the signals which characterize the operation of the above disclosed circuit. The left-hand section of this chart shows normal or malfunction free operation while the right-hand side section shows the operation which occurs in the event of a malfunction.

As shown, the differential circuit 210 produces a pulse (see chart "A") each time the pump 136 is started or stopped. The period responsive circuit 214 responds to each of the pulses in a manner to be "reset" by same and thereafter develop a voltage which develops essentially proportionally with respect to time (see chart "B"). Accordingly, the greater the lapse of time between any two pulses the higher the voltage becomes. By setting the reference voltage (REF $\overline{V}$) of the comparator at a suitable level, it is possible to render the warning device active (see chart "D") only after the pump has been running or alternatively has not been energized for a period of time in excess of that experienced under normal (malfunction free) operation.

Figure 8:
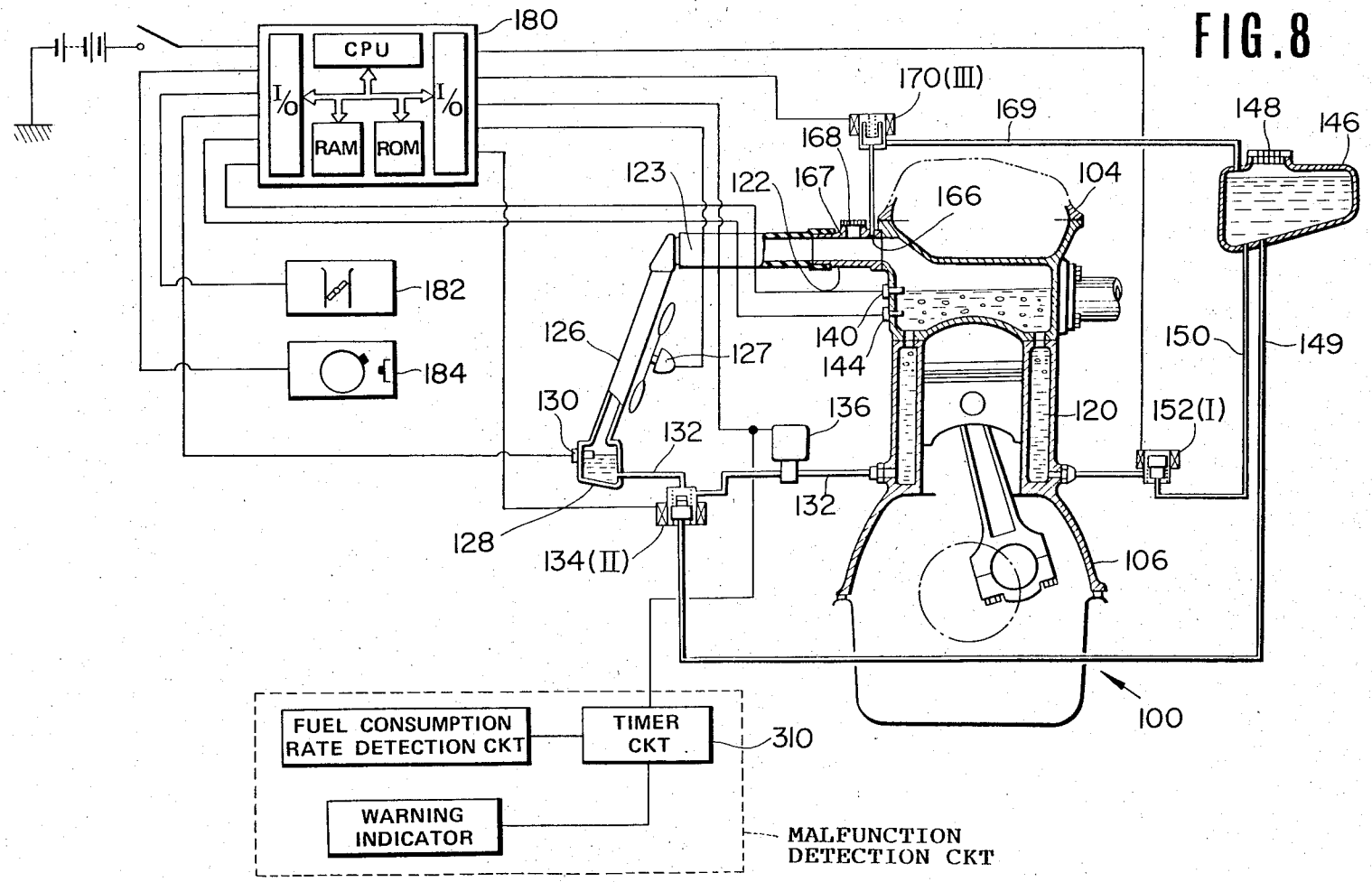
FIG. 8 is a view similar to that shown in FIG. 7 showing a second embodiment of the present invention.
Figure 11:
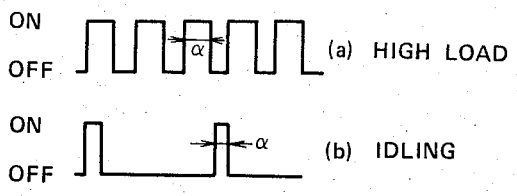
FIG. 11 is a chart comparing the pump operation characteristics which occur at high and low (idling) load conditions, respectively.
Figure 12:
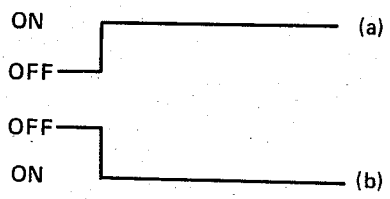
FIG. 12 is a chart which shows the continuous ON and the continuous OFF pump characteristics which occur when a system malfuction takes place.

FIG. 8 shows a second embodiment of the present invention. This arrangement takes into account the changes in pump operation characteristics which occur with changes in engine load. Viz., under high load the amount of power that must be produced by the engine is high and accordingly a relatively large amount of fuel is combusted to produce the necessary power output. The more fuel that is combusted, the more heat that is produced by the engine. Under these circumstances the amount of coolant that must be circulated by the pump increases whereby the time for which the pump operates increases while the time for which it is non-operative decreases. FIG. 11 demonstrates this point graphically. As shown, during idling the time for which the pump is active is relatively short while the intervals between pump energization relatively large. On the other hand, during high load operation such as hill climbing, towing, or high speed cruising, the pump is required to pump more coolant more often. Accordingly, in order to render the monitoring circuit more responsive to the mode of engine operation it is preferred in the second embodiment to render said circuit responsive to a signal indicative of the amount of fuel being fed to the engine. In the case of fuel injected engines, the fuel injector control pulse can be used. On the other hand, in the case of carbureted engines the opening degree of the throttle valve may be used.

The second embodiment includes a timer 310 circuit which determines the time or period for which the pump is active/non-active. In response to a signal indicative of low fuel consumption it is possible to render the timer 310 responsive to the pump 136 being "on" so as to count up to a level at which a warning device (312) energization signal is produced faster than in the case that the pump 136 is not energized. Conversely, when the amount of fuel fed to the engine increases (high load) it is possible by using the signal indicative thereof to increase the rate at which the counter 310 counts up to a value at which the alarm signal is issued or conversely lower the count at which said signal is generated.

The particular circuits which may be used in the above mentioned arrangements will be only too clear to those skilled in the art of electronics. Accordingly, no further description will be given for brevity.

It should be noted that the engine system to which the malfunction detection arrangement of the present invention can be applied is not limited to that illustrated in FIGS. 7 and 8 and may, by way of example take the form of the arrangements disclosed in:

1. copending U.S. patent application Ser. No. 602,451 filed on Apr. 20, 1984 in the name of Hayashi now U.s. Pat. No. 4,545,335;
2. copending U.S. patent application Ser. No. 676,937 filed on Nov. 30, 1984 now U.S. Pat. No. 4,574,747 in the name of Hirano or (alternatively) the corresponding Eurpean patent application No. 84114579.0 filed on Nov. 30, 1984 in the name of Nissan Motor Co. Ltd.;
3. European Patent Application No. 84112777.2 filed on Oct. 23, 1984 in the name of Nissan Motor Co. Ltd.; and
4. European Patent Application No. 84114579.0 filed in Nov. 30, 1984 in the name of Nissan Motor Co. Ltd.

The disclosure contained in these documents is hereby incorporated by reference thereto.

What is claimed is:

1. A cooling system for an internal combustion engine comprising:

a coolant jacket formed about structure of said engine subject to high heat flux;

a first parameter sensor, said first parameter sensor being disposed in said coolant jacket and arranged to sense the temperature of the liquid coolant therein;

a radiator in which coolant vapor is condensed to its liquid form, said radiator communicating with said coolant jacket via a vapor transfer conduit;

a device associated with said radiator for varying the rate at which coolant vapor is condensed to liquid form in said radiator;

means for returning liquid coolant from said radiator to said coolant jacket in a manner to maintain the level of liquid coolant in said coolant jacket above said structure subject to high heat flux and lower than the uppermost section of said coolant jacket so as to provide a vapor collection space above the surface of said liquid coolant; and a circuit which monitors the operation of said liquid coolant returning means and which issues a signal upon the operational characteristics of said liquid coolant returning means indicating a malfunction in said cooling system.

2. A cooling system as claimed in claim 1, wherein said liquid coolant returning means includes:

a small collection tank at the bottom of said radiator;

a coolant return conduit which leads from the collection tank to said coolant jacket;

a first level sensor disposed in said coolant jacket at a first predetermined level which is selected to be higher than said structure subject to high heat flux and lower than the uppermost section of said coolant jacket; and a pump disposed in said coolant return conduit, said pump being responsive to said first level sensor indicating that the level of coolant in said coolant jacket has fallen below same, in a manner to pump liquid coolant from said collection tank to said coolant jacket until the level of liquid coolant in said coolant jacket rises to said first level sensor.

3. A method of cooling an internal combustion engine comprising the steps of:

(a) introducing liquid coolant into a coolant jacket formed about structure of said engine subject to high heat flux in a manner to immerse said structure in a predetermined depth of liquid coolant;

(b) allowing the liquid coolant in said coolant jacket to boil;

(c) transferring the coolant vapor produced by the boiling in said coolant jacket from said coolant jacket to a radiator using a vapor transfer conduit;

(d) condensing the vapor to its liquid form in said radiator;

(e) returning liquid coolant from said radiator to said first coolant jacket using a coolant return arrangement in a manner to maintain said structure subject to high heat flux immersed to said predetermined depth of liquid coolant and define a vapor collection space within said coolant jacket;

(f) monitoring the operation of said liquid coolant returning means; and (g) issuing a signal upon said step of monitoring indicating that the operation characteristics of said coolant returning means deviates from a predetermined schedule.

4. A method as claimed in claim 3, further comprising the steps of:

(h) collecting the condensed coolant in a small collection tank disposed at the bottom of said radiator;

(i) sensing the level of coolant in said coolant jacket using a first level sensor which is disposed in said coolant jacket at a first predetermined level which is selected to be higher than said structure subject to high heat flux and lower than the uppermost section of said coolant jacket; and (j) pumping coolant from said collection tank to said coolant jacket using a pump disposed in a coolant return conduit.

5. A cooling system for an internal combustion engine comprising:

a coolant jacket formed about structure of said engine subject to high heat flux;

a radiator in which coolant vapor is condensed to liquid form;

a vapor transfer conduit leading from said coolant jacket to said radiator;

means for returning liquid coolant from said radiator to said coolant jacket in a manner to maintain the level of liquid coolant in said coolant jacket above said structure subject to high heat flux and lower than the uppermost section of said coolant jacket so as to provide a vapor collection space above the surface of said liquid coolant; and a circuit which monitors the operation of said liquid coolant returning means and which issues a signal upon the operational characteristics of said liquid coolant returning means indicating a malfunction in said cooling system;

wherein said liquid coolant returning means includes:

a small collection tank at the bottom of said radiator;

a coolant return conduit which leads from the collection tank to said coolant jacket;

a first level sensor disposed in said coolant jacket a first predetermined level which is selected to be higher than said structure subject to high heat flux and lower than the uppermost section of said coolant jacket; and a pump disposed in said coolant return conduit, said pump being responsive to said first level sensor indicating that the level of coolant in said coolant jacket has fallen below same, in a manner to pump liquid coolant from said collection tank to said coolant jacket until the level of liquid coolant in said coolant jacket rises to said first level sensor; and wherein said circuit monitors the operation of said pump and issues said malfunction indicating signal in the event that the time between changes in pump operation exceeds a predetermined period.

6. A cooling system as claimed in claim 5, further comprising means for producing a second signal indicative of the amount of heat being produced by said engine, said circuit being responsive to said second signal in a manner to vary said predetermined period as the amount of heat produced by said engine increases.

7. A cooling circuit as claimed in claim 5, wherein said circuit includes:

a timer circuit which times the intervals between changes in pump operation, said timer being responsive to said second signal to vary the timing at which said first signal is initiated.

8. A cooling system for an internal combustion engine comprising:

a coolant jacket formed about structure of said engine subject to high heat flux;

a radiator in which coolant vapor is condensed to liquid form;

a vapor transfer conduit leading from said coolant jacket to said radiator;

means for returning liquid coolant from said radiator to said coolant jacket in a manner to maintain the level of liquid coolant in said coolant jacket above said structure subject to high heat flux and lower than the uppermost section of said coolant jacket so as to provide a vapor collection space above the surface of said liquid coolant; and a circuit which monitors the operation of said liquid coolant returning means and which issues a signal upon the operational characteristics of said liquid coolant returning means indicating a malfunction in said cooling system;

wherein said liquid coolant returning means includes:

a small collection tank at the bottom of said radiator;

a coolant return conduit which leads from the collection tank to said coolant jacket;

a first level sensor disposed in said coolant jacket at a first predetermined level which is selected to be higher than said structure subject to high heat flux and lower than the uppermost section of said coolant jacket; and a pump disposed in said coolant return conduit, said pump being responsive to said first level sensor indicating that the level of coolant in said coolant jacket has fallen below same, in a manner to pump liquid coolant from said collection tank to said coolant jacket until the level of liquid coolant in said coolant jacket rises to said first level sensor; and wherein said circuit includes:

a differential circuit which produces a pulse each time said pump changes its mode of operation;

a period determining circuit which produces a voltage signal the magnitude of which increases with the time between pulses from said differential circuit; and a comparator which comprises the voltage signal from said period determining circuit with a preselected voltage.

9. A cooling system for an internal combustion engine comprising:

a coolant jacket formed about structure of said engine subject to high heat flux;

a radiator in which coolant vapor is condensed to liquid form;

a vapor transfer conduit leading from said coolant jacket to said radiator;

means for returning liquid coolant from said radiator to said coolant jacket in a manner to maintain the level of liquid coolant in said coolant jacket above said structure subject to high heat flux and lower than the uppermost section of said coolant jacket so as to provide a vapor collection space above the surface of said liquid coolant;

a circuit which monitors the operation of said liquid coolant returning means and which issues a signal upon the operational characteristics of said liquid coolant returning means indicating a malfunction in said cooling system;

a reservoir containing liquid coolant; and valve and conduit means for selectively establishing fluid communication between said coolant jacket and said reservoir;

wherein said liquid coolant returning means includes:

a small collection tank at the bottom of said radiator;

a coolant return conduit which leads from the collection tank to said coolant jacket;

a first level sensor disposed in said coolant jacket at a first predetermined level which is selected to be higher than said structure subject to high heat flux and lower than the uppermost section of said coolant jacket; and a pump disposed in said coolant return conduit, said pump being responsive to said first level sensor indicating that the level of coolant in said coolant jacket has fallen below same, in a manner to pump liquid coolant from said collection tank to said coolant jacket until the level of liquid coolant in said coolant jacket rises to said first level sensor.

10. A cooling system for an internal combustion engine comprising:

a coolant jacket formed about structure of said engine subject to high heat flux;

a radiator in which coolant vapor is condensed to liquid form;

a vapor transfer conduit leading from said coolant jacket to said radiator;

means for returning liquid coolant from said radiator to said coolant jacket in a manner to maintain the level of liquid coolant to said coolant jacket above said structure subject to high heat flux and lower than the uppermost section of said coolant jacket so as to provide a vapor collection space above the surface of said liquid coolant;

a circuit which monitors the operation of said liquid coolant returning means and which issues a signal upon the operational characteristics of said liquid coolant returning means indicating a malfunction in said cooling system;

a device associated with said radiator for varying the rate at which coolant vapor is condensed to liquid form in said radiator;

a first parameter sensor responsive to the temperature of the liquid coolant in said coolant jacket;

a second parameter sensor responsive to a parameter which varies with the load on the engine; and means responsive to said first and second parameter sensors for controlling said device in a manner which tends to increase the temperature at which the coolant boils to a first predetermined temperature when the load on the engine is within a predetermined range and for controlling said device in a manner which tends to decrease the temperature at which the coolant boils to a second predetermined temperature when the load on said engine is outside said predetermined range;

wherein said liquid coolant returning means includes:

a small collection tank at the bottom of said radiator;

a coolant return conduit which leads from the collection tank to said coolant jacket;

a first level sensor disposed in said coolant jacket at a first predetermined level which is selected to be higher than said structure subject to high heat flux and lower than the uppermost section of said coolant jacket; and a pump disposed in said coolant return conduit, said pump being responsive to said first level sensor indicating that the level of coolant in said coolant jacket has fallen below same, in a manner to pump liquid coolant from said collection tank to said coolant jacket until the level of liquid coolant in said coolant jacket rises to said first level sensor.

11. A cooling system for an internal combustion engine comprising:

a coolant jacket formed about structure of said engine subject to high heat flux;

a radiator in which coolant vapor is condensed to liquid form;

a vapor transfer conduit leading from said coolant jacket to said radiator;

means for returning liquid coolant from said radiator to said coolant jacket in a manner to maintain the level of liquid coolant in said coolant jacket above said structure subject to high heat flux and lower than the uppermost section of said coolant jacket so as to provide a vapor collection space above the surface of said liquid coolant;

a circuit which monitors the operation of said liquid coolant returning means and which issues a signal upon the operational characteristics of said liquid coolant returning means indicating a malfunction in said cooling system;

a reservoir containing liquid coolant; and valve and conduit means for selectively establishing fluid communication between said coolant jacket and said reservoir;

wherein said liquid coolant returning means includes:

a small collection tank at the bottom of said radiator;

a coolant return conduit which leads from the collection tank to said coolant jacket;

a first level sensor disposed in said coolant jacket at a first predetermined level which is selected to be higher than said structure subject to high heat flux and lower than the uppermost section of said coolant jacket; and a pump disposed in said coolant return conduit, said pump being responsive to, said first level sensor indicating that the level of coolant in said coolant jacket has fallen below same, in a manner to pump liquid coolant from said collection tank to said coolant jacket until the level of liquid coolant in said coolant jacket rises to said first level sensor; and wherein said valve and conduit means includes:

a fill/discharge conduit which leads from said reservoir and communicates with a lower portion of said coolant jacket;

a first valve disposed in said fill/discharge conduit, said first valve having a first position wherein communication is permitted between said coolant jacket and said reservoir and a second position wherein communication between said radiator and said radiator is prevented;

a supply conduit which leads from said reservoir and which communicates with said return conduit at a location upstream of said second pump;

a second valve disposed at the junction of said supply conduit and said return conduit and which in a first state establishes communication between said pump and said radiator via said return conduit and which in a second state establishes communication between said pump and said reservoir via said supply conduit;

an overflow conduit which leads from an upper section of the coolant jacket to said reservoir; and a third valve disposed in said overflow conduit, said third valve having a first normal position wherein communication between said coolant jacket and said reservoir is prevented and a second position wherein communication is established between said coolant jacket and said reservoir.

12. A method of cooling an internal combustion engine comprising the steps of:

(a) introducing liquid coolant into a coolant jacket formed about structure of said engine subject to high heat flux in a manner to immerse said structure in a predetermined depth of liquid coolant;

(b) allowing the liquid coolant in said coolant jacket to boil;

(c) transferring the coolant vapor produced by the boiling in said coolant jacket from said coolant jacket to a radiator using a vapor transfer conduit;

(d) condensing the vapor to its liquid form in said radiator;

(e) returning liquid coolant from said radiator to said first coolant jacket using a coolant return arrangement in a manner to maintain said structure subject to high heat flux immersed in said predetermined depth of liquid coolant and define a vapor collection space within said coolant jacket;

(f) monitoring the operation of said liquid coolant returning means;

(b) issuing a signal upon said step of monitoring indicating that the operation characteristics of said coolant returning means deviates from a predetermined schedule;

(h) collecting the condensed coolant in a small collection tank disposed at the bottom of said radiator;

(i) sensing the level of coolant in said coolant jacket using a first level sensor which is disposed in said coolant jacket at a first predetermined level which is selected to be higher than said structure subject to high heat flux and lower than the uppermost section of said coolant jacket; and (j) pumping coolant from said collection tank to said coolant jacket using a pump disposed in a coolant return conduit;

wherein said monitoring step includes the steps of:

(k) monitoring the operation of said pump; and (l) initiating the issuance of said signal when the time between changes of pump operation exceeds a predetermined period.

13. A method as claimed in claim 12, further comprising the steps of:

(m) sensing the amount of fuel being fed to said engine; and (n) modifying said predetermined period in accordance with the amount of fuel sensed in step (m).

* * * * *